US005209026A

United States Patent [19]

Cariou et al.

[11] Patent Number: 5,209,026

[45] Date of Patent: May 11, 1993

[54] DEVICE FOR FASTENING A HOLDING PART ON AN EYEGLASS LENS, INCORPORATING A LOCKABLE ARM

[75] Inventors: Jean-Louis Cariou, Roissy-en-Brie; Christian Joncour, Saint Maurice; Claude Borius, Bagnolet; Philippe Clara, Le Perreux; Francois Brule, Champigny, all of France

[73] Assignee: Essilor International Cie Generale D'Optique, Creteil Cedex, France

[21] Appl. No.: 772,495

[22] Filed: Oct. 7, 1991

[30] Foreign Application Priority Data

Oct. 25, 1990 [FR] France ..... 2-13233

[51] Int. Cl.[5] ..... B24B 13/00

[52] U.S. Cl. ..... 51/277; 51/216 LP

[58] Field of Search ..... 51/277, 216 LP, 217 L

[56] References Cited

U.S. PATENT DOCUMENTS 2,580,507 1/1952 Bernheim et al. ..... 51/277
4,479,332 10/1984 Stern ..... 51/277
4,543,752 10/1985 Kotting ..... 51/277
5,070,657 12/1991 Brule et al. ..... 51/277

FOREIGN PATENT DOCUMENTS 2608492 6/1988 France .

*Primary Examiner*—Roscoe V. Parker
*Attorney, Agent, or Firm*—Young & Thompson

[57] ABSTRACT

A device for fastening a holding part on an eyeglass frame placed on a plate comprises an arm adapted to receive removably the holding part and a carriage on which the arm pivots between a raised loading end position and a lowered fitting end position. The carriage is mobile on a frame in a straight line between a retracted rest end position and an advanced end of travel position. A transmission system operative between a drive system and either the arm or the carriage is such that, at least when the carriage is in the vicinity of its advanced end of travel position, the arm is in its retracted fitting position. A locking device is operative between the arm and the carriage to lock the arm releasably to the carriage when in its lowered rest position.

16 Claims, 4 Drawing Sheets

DEVICE FOR FASTENING A HOLDING PART ON AN EYEGLASS LENS, INCORPORATING A LOCKABLE ARM

BACKGROUND OF THE INVENTION

1. Field of the Invention

The present invention is generally concerned with fitting a holding part onto an eyeglass lens to be worked on, for example trimmed, the holding part being adapted to adhere to the lens temporarily, by means of a sucker, for example, to enable the lens to be fitted to and locked in position on a machine for carrying out the work.

It is more particularly directed to the case where a mechanical device is used to fit the holding part onto the eyeglass lens.

2. Description of the Prior Art

The present invention is even more particularly concerned with the case where, as in arrangements of the kind described in U.S. patent application Ser. No. 588 355 filed 26 Sept. 1990, now U.S. Pat. No. 5,070,657, the device employed for fastening a holding part on an eyeglass lens placed on a plate carried by a frame comprises an arm adapted to receive removably said holding part, a carriage on which said arm is able to provide between a raised loading end position and a lowered fitting end position and a frame on which said carriage is mobile in a straight line between a retracted rest end position and an advanced end of travel end position, drive means and a transmission operative between said carriage and/or said arm so that when the carriage is near its end of travel position the arm is in its retracted rest position.

In this way the pivoting of the arm and the displacement of the carriage advantageously result from the same movement imparted by the drive means, the arm reaching its fitting position before the carriage moves towards its end of travel position or during such movement, and normally returning to the loading position after the carriage has returned to its rest position.

This arrangement is satisfactory.

However, it is found that in some situations at least there may be some uncertainty as to the effective sequence of execution of the pivoting of the arm relative to the displacement of the carriage.

For example, if the arm is raised prematurely, as soon as the return movement of the carriage begins, for example, there is the risk of unwanted interference between the arm and the eyeglass lens on which it has just placed a holding part.

As a result the eyeglass lens may be dropped and broken.

A general object of the present invention is an arrangement allowing this drawback to be avoided and conferring other advantages.

SUMMARY OF THE INVENTION

The present invention consists in a device for fastening a holding part on an eyeglass frame placed on a plate, comprising an arm adapted to receive removably said holding part, a carriage on which said arm is able to pivot between a raised loading end position and a lowered fitting end position and a frame on which said carriage is mobile in a straight line between a retracted rest end position and an advanced end of travel end position, drive means and, operative between said drive means and either said arm or said carriage, a transmission system such that, at least when said carriage is in the vicinity of its advanced end of travel position, said arm is in its retracted fitting position, said device further comprising locking means operative between said arm and said carriage to lock said arm releasably to said carriage when in its lowered rest position.

The locking means are preferably operative throughout displacement of the carriage in one direction or the other.

They advantageously prevent the arm from being raised prematurely after fitting the holding part.

In this way interference with the eyeglass lens onto which the holding part has been fastened is prevented.

Furthermore, said locking means are advantageously exploited to achieve accurate positioning of the arm in its fitting position.

The holding part can therefore and advantageously be fitted in a particularly precise way, in a position accurately centered relative to the eyeglass lens concerned.

The features and advantages of the invention will emerge from the following description given by way of example and with reference to the appended diagrammatic drawings.

DETAILED DESCRIPTION OF THE INVENTION

Figure 4:
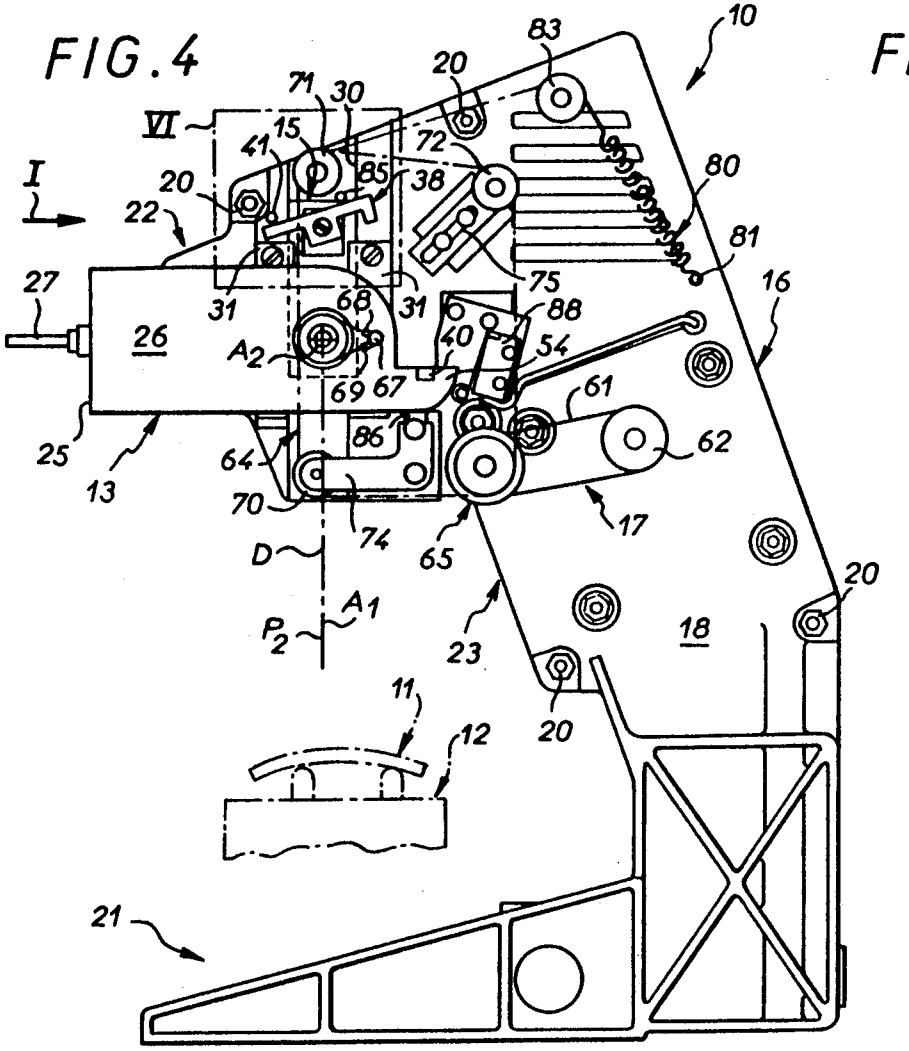
FIG. 4 is a side view of it as seen in the direction of the arrow IV in FIG. 1.
Figure 3:
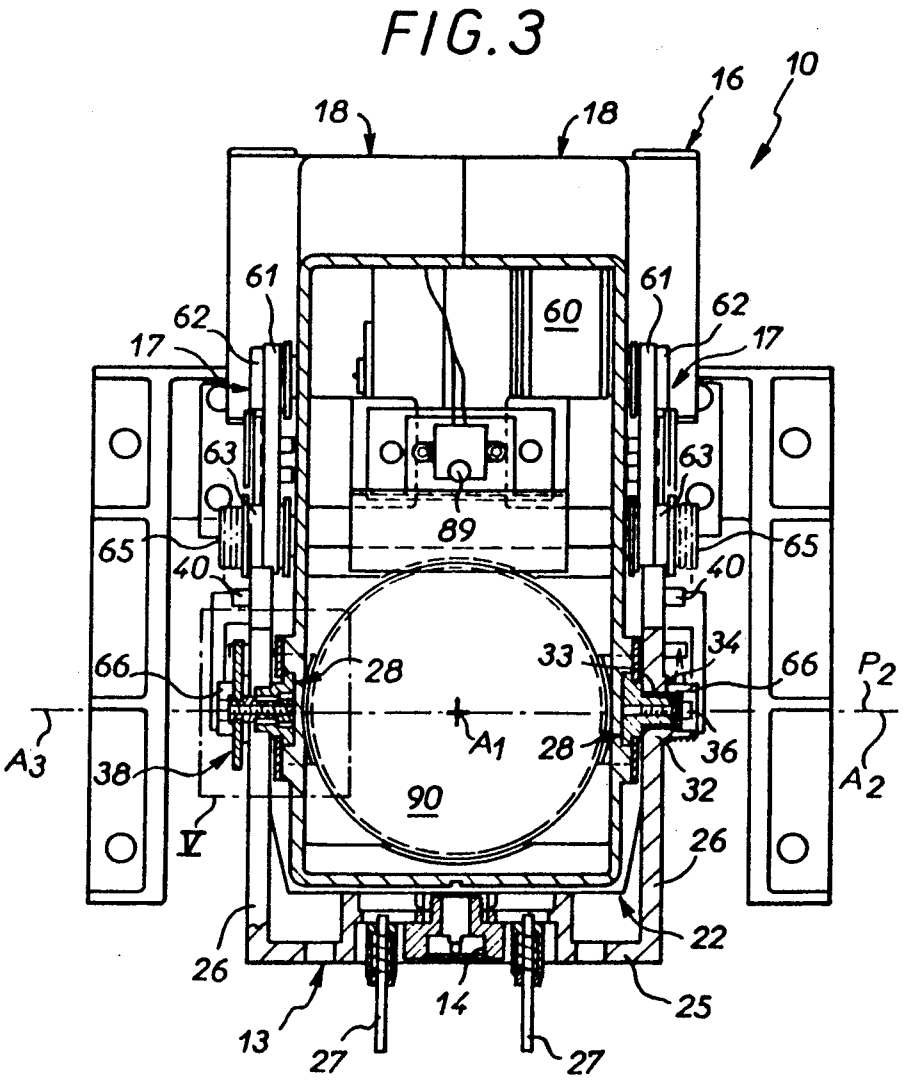
FIG. 3 is a view of it in transverse cross-section on the line III—III in FIG. 1.
Figure 2:
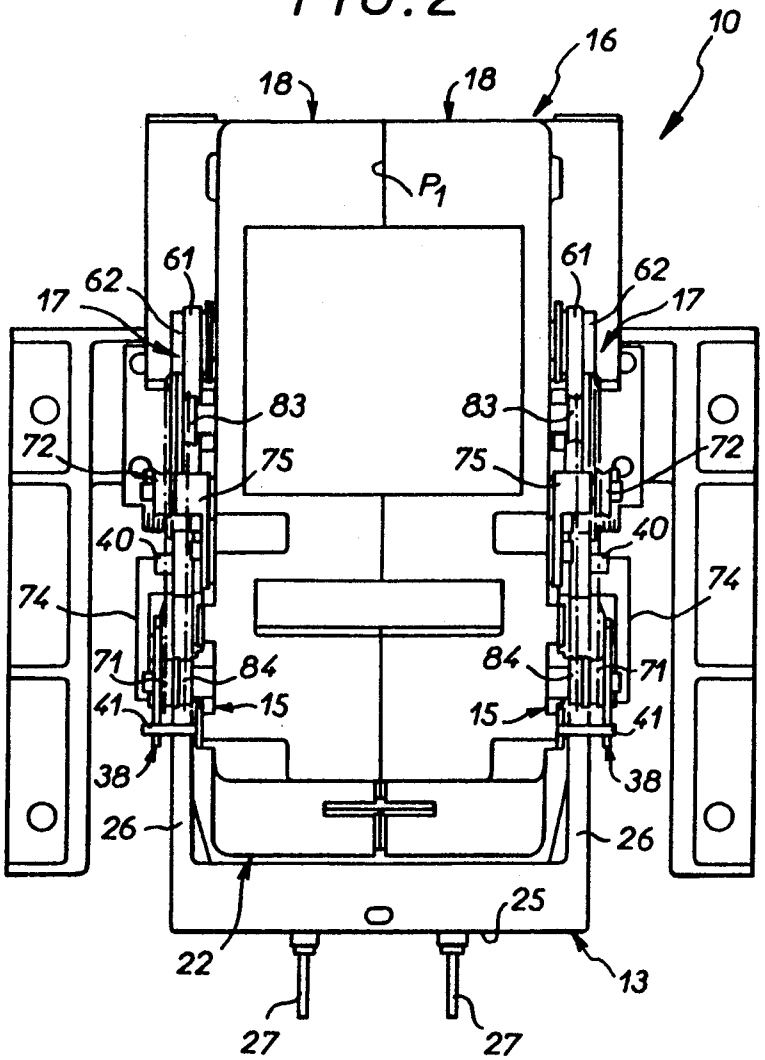
FIG. 2 is a top view of it as seen in the direction of the arrow II in FIG. 1.
Figure 9:
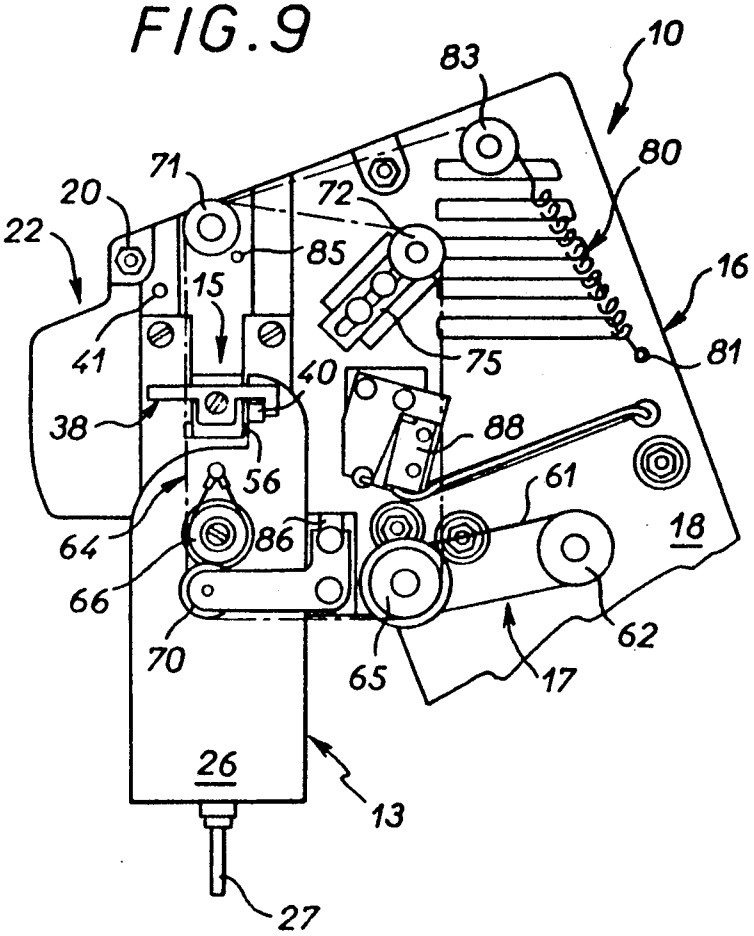
FIG. 9 is a side view repeating part of FIG. 4 and showing the advanced end of travel position of the carriage and the lowered fitting position of the arm.
Figure 8:
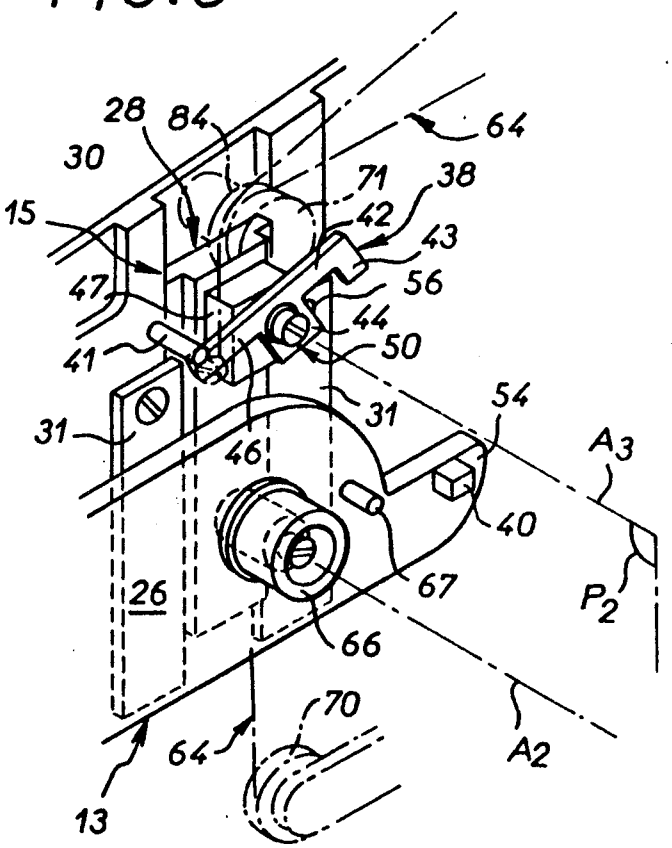
FIG. 8 is a partial perspective view showing one of the slide members of the carriage of the device.

As shown in the FIGS., a device 10 in accordance with the invention for fastening a holding part (not shown) on an eyeglass lens 11 placed on a plate 12 as schematically represented in chain-dotted outline in FIG. 4 comprises an arm 13 adapted to receive removably the holding part and which comprises to this end a receptacle 14 (FIGS. 1 and 3), a carriage 15 on which the arm 13 pivots between two end positions, namely a raised loading position shown in FIGS. 1 through 4 and a lowered fitting position as shown in FIG. 9. The carriage is mobile in a straight line on a frame 16 between two end positions, namely a retracted rest position shown in FIGS. 1 through 4 and an advanced end of travel position shown in FIG. 9. Drive means to be described in more detail later are operative between said drive means and either the arm 13 or the carriage 15. A transmission system 17, also to be described in more detail later, is such that, at least when the carriage 15 is in the vicinity of its advanced end of travel position, the arm 13 is in its lowered fitting position as shown in FIG. 9.

The particularly rigid frame 16 comprises two shell members 18 which fit together on a plane P1 containing the fitting axis A1, that is to say the axis along which the holding part is fitted, and which are fastened together at various points by tie-rods 20.

Referring to FIG. 4, the frame 16 comprises a plinth 21 by means of which it may be attached directly or indirectly using spacers to any kind of support, for example the frame of a contour tracing device, a head section 22 on which the arm 13 at the carriage 15 are mounted, and a body section 23 joining the plinth to the head section 22.

The arm 13 is stirrup-shaped.

It has a median part 25 with the receptacle 14 on its front and two side arms 26 enclosing the head 22 of the frame 16.

By virtue of arrangements which, as they do not form any part of the present invention, will not be described here, the median part 25 of the arm 13 carries two ejectors 27 disposed on respective sides of the receptacle 14 and adapted to bear on the eyeglass lens 11 to hold the latter onto the plate 12 during return movement of the carriage 15 from its advanced end of travel position to its retracted rest position.

The carriage 15 comprises two slide members 28, one associated with each side arm 26 of the arm 13. Each slide member 28 has a generally rectangular contour and moves in one of two grooves 30 provided for this purpose on the frame 16.

The grooves 30 are formed on the outside surface of the respective shell members 18 of the frame 16. Plates 31 are attached to the shell members 18 to either side of the grooves 30, which they partially cover, to retain the slide members 28.

The reference letter D denotes the direction of displacement of the slide members 28.

The direction of displacement of the carriage 15 that they form is coincident with the fitting axis A1.

Each side arm 26 of the arm 13 forms a hub 32 journalled via a bearing 33 on a cylindrical boss 34 projecting locally from the respective slide member 28, to effect the pivoting mounting of the arm 13 on the carriage 15.

Each such mounting is secured by a respective screw 36 on each side arm 26 of the arm 13.

The screw 36 locks the inner race of one bearing 33. The inner race of the other bearing is free to rotate. Any assembly clearances between the various component parts in question are therefore accumulated from the first bearing race.

The arm 13 pivots on the carriage 15 about the axis A2.

This is orthogonal to the direction of displacement D of the carriage 15.

With this direction it defines a fitting plane P2.

Locking means are operative between the arm 13 and the carriage 15 to releasably lock the arm 13 to the carriage 15 when in its lowered fitting position.

These locking means comprise a pawl 38 carried by the carriage 15, a peg 40 projecting from the arm 13 and intercepting the path of movement of the pawl 38, spring return means to be described later urging the pawl 38 continuously towards an active position in which, as shown in FIG. 9, it is able to hook over the peg 40 and, to retain the pawl 38 in the inactive position, away from the peg 30, when the carriage is in the retracted rest position as shown in FIGS. 1 through 4, an abutment member 41 carried by the frame 16 and also intercepting the path of movement of the pawl 38, on the opposite side of the latter as compared with the peg 40.

In an alternative arrangement (not shown), the pawl 38 is carried by the arm 13 and the associated peg 40 projects from the carriage 15. In the arrangement shown there are two pawls 38, one on each side arm 36 of the arm 13, and two pegs 40.

The pawls 38 pivot on the carriage 15 about the axis A3.

This axis is parallel to the pivot axis A2 of the arm 13 on the carriage 15 and, like the latter axis, lies in the fitting plane P2.

For reasons that will emerge later, each pawl 38 is adjustable in position on the carriage 15 in the direction perpendicular to the fitting plane P2, in other words to the plane containing the direction of displacement D of the carriage 15 and the .pivot axis A2 of the arm 13.

Each pawl 38 is carried by a respective slide member 28 of the carriage 15.

Each pawl is in the form of a plate parallel to the slide member 28 and comprises a lever arm 42 with a right-angled return 43 at its end, with a substantially straight flank, through which it is adapted to hook over the associated peg 40, a median part 44 by means of which it is pivoted to an appropriately shouldered hub 45 carried by the respective slide member 28, and a lever arm 46 aligned with the lever arm 42 and extending to the other side of the median part 44 as compared with the lever arm 42, by which it is adapted to be actuated by the respective abutment member 41.

Each hub 45 passes through the respective slide member 28 of the carriage 15 by means of a boss 47 which locally increases the thickness of the slide member 28.

Figure 5:
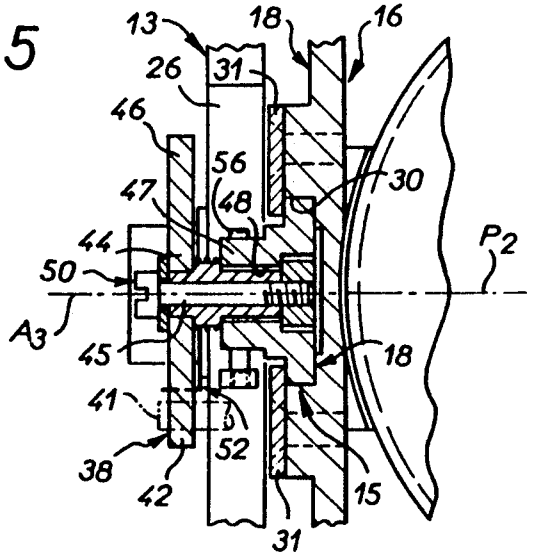
FIG. 5 shows to a larger scale the part of FIG. 3 identified by a box V in FIG. 3.
Figure 6:
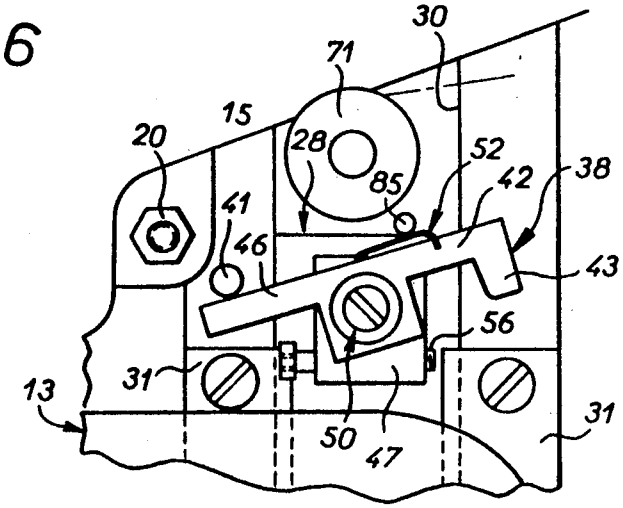
FIG. 6 shows to a larger scale the part of FIG. 4 identified by a box VI in FIG. 4.

The boss 47 comprises a slot 48 perpendicular to the fitting plane P2 (see FIG. 5).

The position of the pawls 38 can be adjusted because of the presence of the slot 48.

The corresponding assembly is secured by a screwthreaded tie-rod 50.

It suffices to tighten the screw for the hub 45 carrying one pawl 38 to be locked in position on the slide member 28 carrying it.

The return spring means associated with each pawl 38 comprise a torsion spring 52 the median part of which is fitted over the hub 45, one arm of which is hooked onto the pawl 38 and the other arm of which is hooked onto the respective slide member 28.

The peg 40 associated with each pawl 38 is in the form of a boss projecting from the respective side arm 26 of the arm 13, to be more precise from an extension 54 of the latter.

The peg 40 has a rectangular cross-section with two faces parallel to the fitting plane P2 and two faces perpendicular thereto.

The faces of the peg 40 parallel to the fitting plane P2 cooperate hookwise with the associated pawl 38.

To support the arm 13 in its lowered fitting position the carriage 15 carries an abutment member 56 that is adjustable in position perpendicularly to the fitting plane P2.

This abutment member 56 is the end of a screw passing through the boss 47 on one of the slide members 28 of the carriage 15 perpendicularly to the fitting plane P2.

During assembly, the arm 13 is placed against the abutment member 56, as shown in FIG. 9.

The abutment member is then adjusted until, in the retracted fitting position which it then occupies, the arm 13 lies accurately along the fitting axis A1, to ensure centering of the holding part to be fitted.

The pawls 38 are then hooked over the pegs 40 and, in the manner previously described, their position is adjusted until the right-angle return 43 on the lever arm 42 has its substantially straight flank very accurately in contact with the appropriate face of the peg 40.

In the lowered fitting position, the arm 13 is therefore firmly locked between two bearing points, one constituted by the abutment member 56 and the other by the pawls 38.

The abutment member 41 associated with each pawl 38 is a simple pin carried by the respective shell member 18 of the frame 16.

The drive means used to tilt the arm 13 and to displace the carriage 15 comprise an electric motor 60 accommodated in the frame 16.

The transmission system 17 operative between this motor 60 and either the arm 13 or the carriage 15 is of the gear and belt type.

Of course, the term "belt" must be understood in the widest possible sense encompassing cables as well as belts proper, and, likewise, the gears may be simple pulley wheels.

This transmission system 17 comprises at least one notched belt 61 running in an endless loop over two gears 62, 63 one of which is keyed to the output shaft of the motor 60 and the other of which is mounted to rotate on the frame 16. It further comprises at least one cable 64 forming an endless loop and locally looped over a pulley wheel 65 constrained to rotate with the gear 63, being passed several times around the pulley wheel 65.

The pulley wheel 65 is therefore a drive pulley wheel for the cable.

This assembly extends along one side of the frame 16.

The cable 64 is also looped locally over a direction-changing member 66 carried by the arm 13, to be more precise by the respective side arm 26 of the latter.

The direction-changing member 66 is keyed to the arm 13.

It is in the form of a tubular extension of the hub 32 of the respective side arm 26.

The direction-changing member 66 is therefore coaxial with the pivot axis A2 of the arm 13.

The two ends 68, 69 of the cable 64 are both attached to the arm 16 by a peg 67 after passing over the direction-changing member 66.

The cable 64 extends parallel to the direction of displacement D of the carriage 15 and to either side of the direction-changing member 66.

The respective runs extend on the same side of the direction-changing member 66, both in a plane parallel to and in the immediate proximity of the fitting plane P2.

The force applied to the carriage 15 through the cable 64 from the arm 13 is therefore as close as possible to the direction of displacement D of the carriage 15, parallel thereto, to the benefit of overall efficiency.

In addition to the direction-changing member 66 carried by the arm 13 and the drive pulley 65, the cable 64 passes over other direction-changing members 70, 71, 72 all carried by the frame 16.

The two direction-changing members 70, 71 are aligned with the direction-changing member 66 carried by the arm 13, one on each side of the latter.

The direction-changing member 70, which faces the drive pulley 65, is carried by an arm 74 attached to the frame 16 to allow for the transverse offset induced by the drive pulley 65 because of the multiple turns of the cable 64 around it and to be spaced from the frame 16 to enable the arm 13 to pass between it and the latter when the arm 13 is in the lowered fitting position.

The direction-changing member 71 is carried directly by the frame 16.

The direction-changing member 72 is carried by a slide member 75 adjustable in position on the frame 16 to tension the cable.

It follows from the foregoing description that the cable 64 forms a generally rectangular loop at the corners of which are the drive pulley 65 and the direction-changing members 70, 71, 72.

Each direction-changing member 70, 71, 72 is a rotating pulley wheel.

The cable 64 runs around the outside of each of them and the drive pulley 65, all the pulley wheels lying inside the loop formed by the cable.

There is therefore no need to provide any direction-changing member on the carriage 15.

Figure 1:
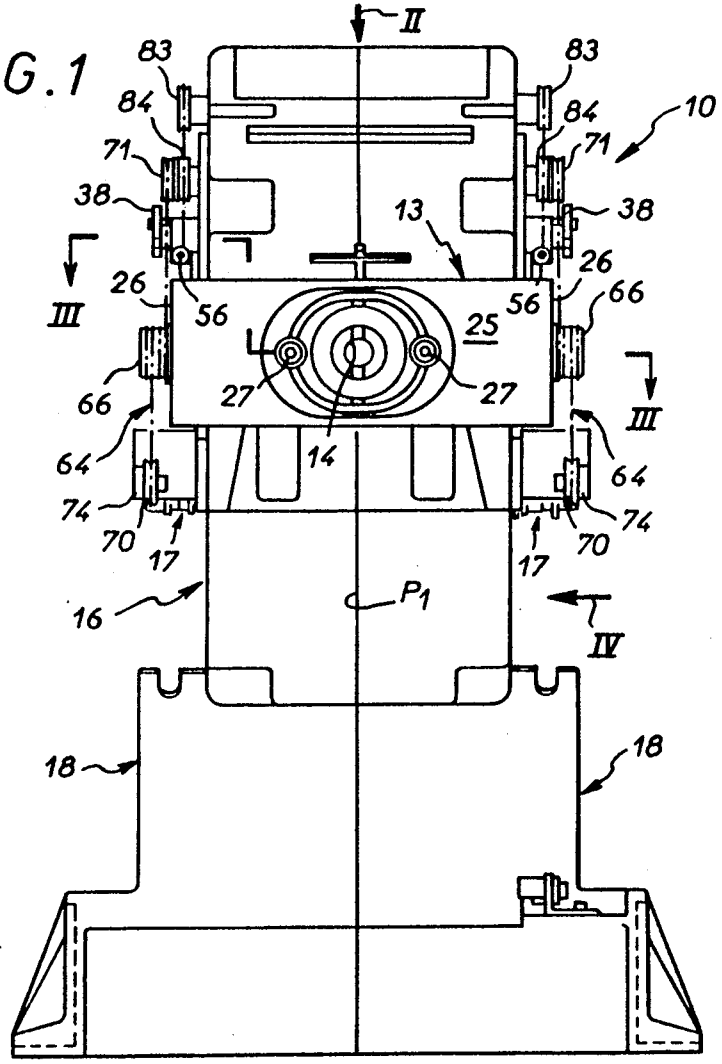
FIG. 1 is a view in elevation as seen in the direction of the arrow I in FIG. 4 of a device in accordance with the invention for fastening a holding part on an eyeglass lens, with its carriage in the retracted rest position and its arm in the raised loading position.
Figure 7:
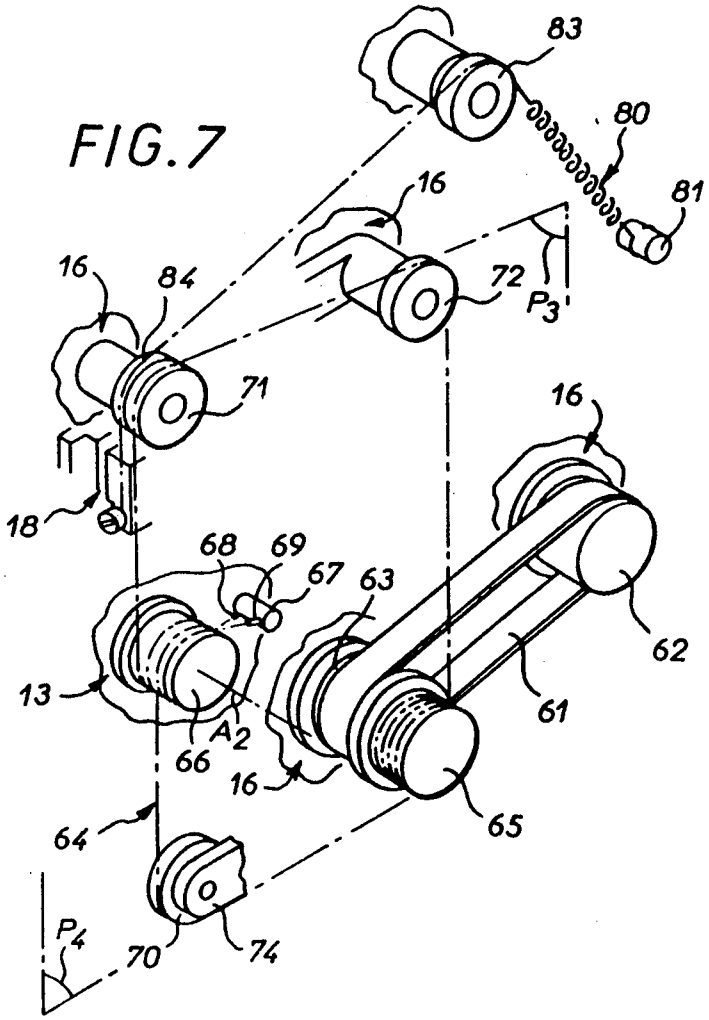
FIG. 7 is a schematic perspective view of a part of the transmission employed in the device.

As can be seen more clearly in FIGS. 1 and 7, the cable 64 runs in two planes P3, P4 both perpendicular to the fitting plane P2 and offset relative to each other in the direction of the pivot axis A2 of the arm 13, the cable passing from one plane P3, P4 to the other at the direction-changing member 66 carried by the arm 13 and at the drive pulley 65 around which the cable 64 is passes several times.

At each of the direction-changing members 70, 71, 72 the two runs of the cable 64 are both advantageously in a plane perpendicular to the rotation axis of the direction-changing member, so minimizing friction and therefore maximizing the service life of the cable 64.

Two cables 64 are used, one on each side of the frame 16 (one per side arm 26 of the arm 13) and two notched belts 61 are likewise used.

As an alternative to this, a single belt may be used, the pulley 65 of the cable 64 on the opposite side being no longer a drive pulley but merely a direction-changing member.

The drive means associated with the arm 13 and the carriage 15 comprise, in addition to the motor 60, spring means adapted, in the rest position of the carriage 15, to overcome the spring force due to the springs 15 constituting the return spring means of the pawls 38 and so to enable the arm 13 to be released.

A spring 80 is coupled at one end to a peg 81 projecting for this purpose from one side of the frame 16 and is connected at its other end to the respective slide member 28 of the carriage 15, by means of the screw forming the abutment member 56 carried by the slide member 28, after passing over two direction-changing members 83, 84 rotatably mounted on the frame 16, the direction-changing member 84 being coaxial with the direction-changing member 71 of the respective cable 64.

Two springs 80 may be employed, one on each respective side of the frame 16.

An abutment member 85 is provided on the frame 16 to define the retracted idle position of the carriage 15.

It is a pin projecting from the frame 16 and intersecting the path of movement of one of the slide members 28 of the carriage 15.

An abutment member 86 is provided on the frame 16 to define the raised position of the arm 13.

It is the head of a screw attached for this purpose to one of the arms 74 carrying a direction-changing member 70.

When the arm 13 is in the raised loading position it operates a microswitch 88 controlling the supply of power to the electric motor 60.

The frame 16 accommodates, in addition to the motor 60, lighting means comprising a lamp 89 associated with a mirror (not visible in the figures) and a lens 90 to direct its beam onto the plate 12.

In the retracted idle position the carriage 15 bears against the abutment member 85 and in the raised loading position the arm 13 bears against the abutment member 86 (see FIG. 4).

After the holding part to be fitted is placed in the receptable 14 the motor 60 is started.

By virtue of arrangements which, as they do not form any part of the present invention, will not be described here, the cut-off signal provided by the microswitch 88 is masked in the control unit to allow this.

Immediately the motor 60 starts, the cables 64 driven by the notched belt 61 rotate the arm 13 through a quarter-turn so that it moves to its lowered fitting position with its side arms 26 bearing on the abutment members 56 provided for them on the carriage 15.

The cables 64 then move the carriage 15 towards its end of travel position.

Immediately this movement starts, the released pawls 38 are hooked over the pegs 40 on the arm 13.

It will be noted that the centres of the contacting surfaces of the right-angle return 43 on the pawls 38 and the pegs 40 on the arm 13 are situated at this time beyond the pivot axis A3 of the pawls 38 relative to their movement of engagement on the pegs 40.

This prevents unwanted unhooking of the pawls 38.

The carriage 15 continues to move until the holding part carried by the arm 13 is applied to the eyeglass lens 11.

Because the arm 13 is accurately positioned relative to the carriage 15 and locked to it and because these forces are applied substantially in the direction of displacement D of the carriage 15, the holding part is advantageously fitted under strictly controlled and secure conditions.

After this, which happens when the carriage 15 reaches its advanced end of travel position, the direction of rotation of the motor 60 is reversed by means which, not forming any part of the present invention, will not be described here.

The result is that the carriage 15 moves in the opposite direction from its advanced end of travel position to its previous retracted rest position.

Throughout this return movement, the arm 13 is advantageously and securely held in the lowered fitting position, without any risk of premature return to the raised loading position.

Shortly before the carriage 15 reaches the abutment member 85 defining its retracted rest position the abutment members 41 carried by the frame 16 cause the pawls 38 to tilt.

This releases the arm 13 which is then caused by the cables 64 to move from its lowered fitting position to its raised loading position, when the side arms 26 contact the respective abutment members 86.

At the end of this movement the arm 13 operates the microswitch 88 to stop the motor 60.

A new working cycle can then begin.

Of course, the present invention is not limited to the embodiment described and shown, but encompasses any variant execution.

Specifically, although in the embodiment described and shown ejectors are provided to hold the eyeglass lens onto the plate after a holding part has been fitted to it, this is not necessarily so.

If ejectors like these are not provided, the arm takes the eyeglass lens with it when the carriage returns from its end of travel position to its rest position, and the initial raised loading position of the arm is also an eyeglass lens offloading position.

There is claimed:

1. Device for fastening a holding part on an eyeglass lens placed on a plate, comprising an arm adapted to receive removably said holding part, a carriage on which said arm is able to pivot between a raised loading end position and a lowered fitting end position and a frame on which said carriage is mobile in a straight line between a retracted rest end position and an advanced end of travel end position, drive means and, operative between said drive means and either said arm or said carriage, a transmission system such that, at least when said carriage is in the vicinity of its advanced end of travel position, said arm is in its lowered fitting end position, said device further comprising locking means operative between said arm and said carriage to lock said arm releasably to said carriage when the arm is in its lowered fitting end position.

2. Device according to claim 1 wherein said locking means comprise at least one pawl carried by either said arm or said carriage and pivoted thereto, a peg projecting from either said carriage or said arm and intersecting the path of movement of said pawl, spring means adapted to urge said pawl continuously towards an active position in which it is adapted to hook onto said peg and, to retain said pawl in an inactive position spaced from said peg when said carriage is in its retracted rest position, an abutment member carried by said frame and intersecting the path of movement of said pawl on the other side of the latter relative to said peg.

3. Device according to claim 2 wherein said pawl is carried by said carriage and the associated peg projects from said arm.

4. Device according to claim 3 wherein said carriage carries an abutment member adjustable in position perpendicularly to the plane containing the pivot axis of said arm and the direction of displacement of said carriage adapted to bear on said arm in its lowered fitting end.

5. Device according to claim 2 wherein said pawl is mounted on said carriage and adjustable in position perpendicularly to the plane containing the pivot axis of said arm and the direction of displacement of said carriage.

6. Device according to claim 2 wherein, when said arm is in its lowered fitting end position, the centers of the contacting faces of said pawl and said peg are situated beyond the axis on which said pawl pivots relative to its movement of engagement over said peg.

7. Device according to claim 2 wherein said arm is strirrup-shaped having a median part and two side arms and there are two pawls, one per side arm of said arm.

8. Device according to claim 1 wherein said transmission system comprises at least one cable passing over a direction-changing member carried by said arm and extending parallel to the direction of displacement of said carriage to either side thereof.

9. Device according to claim 8 wherein said cable runs in two planes both perpendicular to the plane containing the direction of displacement of said carriage and the pivot axis of said arm and are offset relative to each other in the direction of said pivot axis, the cable passing from one of said planes to the other at the direction-changing member carried by said arm and at a drive pulley around which said cable is passed several times.

10. Device according to claim 5 wherein said direction-changing member carried by said arm is locked to said arm and both ends of said cable are connected to said arm after passing over said direction-changing member.

11. Device according to claim 8 wherein said cable passes over said direction-changing member carried by said arm and additionally over other direction-changing members one of which constitutes a drive pulley and all of which are carried by said frame.

12. Device according to claim 11 wherein two of said other direction-changing members are aligned with that carried by said arm, each on a respective side thereof.

13. Device according to claim 8 wherein said cable defines a generally rectangular loop.

14. Device according to claim 7 wherein said arm is stirrup-shaped having a median part and two side arms and said transmission system comprises two cables, one for each side arm of said arm.

15. Device according to claim 1 wherein said arm is strirrup-shaped having a median part and two side arms and said carriage comprises two slide members, one for each side arm of said arm, said slide members being adapted to move in two grooves provided for this purpose on said frame.

16. Device according to claim 1 wherein said frame is formed by two shell members.

* * * * *